US009523995B2

(12) United States Patent
Utsunomiya

(10) Patent No.: US 9,523,995 B2
(45) Date of Patent: Dec. 20, 2016

(54) REFERENCE VOLTAGE CIRCUIT

(71) Applicant: Seiko Instruments Inc., Chiba-shi, Chiba (JP)

(72) Inventor: Fumiyasu Utsunomiya, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 18 days.

(21) Appl. No.: 14/804,536

(22) Filed: Jul. 21, 2015

(65) Prior Publication Data

US 2015/0323952 A1 Nov. 12, 2015

Related U.S. Application Data

(62) Division of application No. 13/424,588, filed on Mar. 20, 2012, now abandoned.

(30) Foreign Application Priority Data

Mar. 25, 2011 (JP) ..... 2011-068036
Sep. 13, 2011 (JP) ..... 2011-199733

(51) Int. Cl.
*G05F 3/16* (2006.01)
*G05F 3/20* (2006.01)
(Continued)

(52) U.S. Cl.
CPC ..... *G05F 3/245* (2013.01)

(58) Field of Classification Search
CPC ..... G05F 3/02; G05F 3/08; G05F 3/10; G05F 3/16; G05F 3/20; G05F 3/22; G05F 3/222; G05F 3/225; G05F 3/24; G05F 3/242;G05F 3/245; G05F 3/26; G05F 3/262; G05F 3/265; G05F 3/267; G05F 3/30; G11C 5/14; G11C 5/147
(Continued)

(56) References Cited

U.S. PATENT DOCUMENTS 5,873,053 A 2/1999 Pricer et al.
6,798,278 B2 * 9/2004 Ueda ..... G05F 3/24 323/313
(Continued)

OTHER PUBLICATIONS

Restriction Requirement for U.S. Appl. No. 13/424,588 dated May 6, 2014, 5 pages.
(Continued)

*Primary Examiner* — Timothy J Dole
*Assistant Examiner* — Carlos Rivera-Perez
(74) *Attorney, Agent, or Firm* — Brinks Gilson & Lione

(57) ABSTRACT

Provided is a reference voltage circuit with improved temperature characteristics. A current based on a current flowing through a first depletion transistor whose gate and source are connected to each other is caused to flow through a third depletion transistor having the same threshold, to thereby generate a voltage between a gate and a source of the third depletion transistor. A current based on a current flowing through a second depletion transistor whose gate and source are connected to each other is caused to flow through a fourth depletion transistor having the same threshold, to thereby generate a voltage between a gate and a source of the fourth depletion transistor. A reference voltage is generated based on a difference voltage of the two voltages, to thereby obtain a reference voltage having less voltage fluctuations with respect to a temperature change.

2 Claims, 3 Drawing Sheets

(51) Int. Cl.
*G05F 1/10* (2006.01)
*G05F 3/02* (2006.01)
*G05F 3/24* (2006.01)

(58) Field of Classification Search
USPC ..... 323/222–226, 271–275, 281–286, 323/311–317, 351, 907; 327/77, 89, 512, 327/513, 538–543
See application file for complete search history.

(56) References Cited

U.S. PATENT DOCUMENTS

| | | | | |
|---|---|---|---|---|
| 2006/0197581 | A1 | 9/2006 | Chun et al. | |
| 2007/0030049 | A1* | 2/2007 | Yoshikawa | G01K 7/01 327/512 |
| 2008/0252360 | A1 | 10/2008 | Yoshikawa | |
| 2011/0074496 | A1* | 3/2011 | Yoshino | G05F 3/242 327/539 |

OTHER PUBLICATIONS

Office Action for U.S. Appl. No. 13/424,588 dated Jul. 25, 2014, 7 pages.
Office Action for U.S. Appl. No. 13/424,588 dated Dec. 23, 2014, 7 pages.

* cited by examiner

REFERENCE VOLTAGE CIRCUIT

RELATED APPLICATIONS

This application is a divisional patent application of U.S. patent application Ser. No. 13/424,588, filed Mar. 20, 2012, which claims priority under 35 U.S.C. §119 to JP2011-068036 filed on Mar. 25, 2011 and JP2011-199733 filed on Sep. 13, 2011, the entire content of which are hereby incorporated by reference.

BACKGROUND OF THE INVENTION

1. Field of the Invention

The present invention relates to a reference voltage circuit with improved temperature characteristics.

2. Description of the Related Art

As illustrated in FIG. 5, a conventional reference voltage circuit includes an N-channel depletion transistor 501 and an N-channel depletion transistor 502.

The operation is described. When a power supply voltage is sufficiently high, the N-channel depletion transistor 501 operates in the saturation region and the N-channel depletion transistor 502 operates in the triode region (variable resistance region). The aspect ratio (W/L) of the N-channel depletion transistor 501 is represented by A501; the threshold thereof, Vtd; the aspect ratio of the N-channel depletion transistor 502, A502; and the threshold thereof, Vtd. A voltage V521 at an output terminal 521 is determined as follows.

[Ex. 1]

$$V_{521} = \left(1 - \frac{\sqrt{A_{502}^2 + A_{501} \cdot A_{502}}}{A_{502}}\right) V_{td} \tag{1}$$

A temperature gradient of the voltage V521 is determined as follows.

[Ex. 2]

$$\frac{dV_{521}}{dt} = \left(1 - \frac{\sqrt{A_{502}^2 + A_{501} \cdot A_{502}}}{A_{502}}\right) \frac{dV_{td}}{dt} \tag{2}$$

As is apparent from Expressions (1) and (2), the conditional expressions of the absolute value of the output voltage V521 and the temperature gradient are determined only by the thresholds and the channel aspect ratios of the depletion transistors and include no terms affected by the mobility.

In general, the temperature gradient of the mobility is nonlinear. The temperature gradient of the threshold, on the other hand, is known to be regarded as linear at about −1 to −2 mV/° C. If the ratio of the aspect ratios of the N-channel depletion transistor 501 and the N-channel depletion transistor 502 is adjusted to 8:1 as a realistic value, the value of the output voltage V521 is |2×Vtd|, and the temperature gradient is given as −2 times the temperature gradient of the same threshold.

As described above, the mobility is not involved in the elements that determine the output voltage and the output characteristics, and hence the output voltage and the output characteristics are determined only by the thresholds of depletion transistors and the ratio accuracy in layout. Further, there are a small number of elements that have manufacturing fluctuations, and hence a stable output can be obtained (see, for example, Japanese Patent Application Laid-open No. 2007-24667 (FIG. 5)).

In the conventional technology, however, a constant gradient is present with respect to temperature, and hence there is a problem in that it is not suitable for a reference voltage circuit which is required to have flat temperature characteristics

SUMMARY OF THE INVENTION

The present invention has been made in view of the above-mentioned problem, and provides a reference voltage circuit capable of obtaining flat temperature characteristics with respect to a temperature change.

The present invention provides a reference voltage circuit, including: a first constant voltage circuit including a first depletion transistor; a second constant voltage circuit including a second depletion transistor having a threshold different from a threshold of the first depletion transistor; and differential amplifier means to which an output voltage of the first constant voltage circuit and an output voltage of the second constant voltage circuit are input.

According to the reference voltage circuit of the present invention, the depletion transistors having different threshold voltages are used to generate a reference voltage based on a difference between voltages generated by the depletion transistors. Therefore, a reference voltage circuit with improved temperature characteristics can be obtained.

DETAILED DESCRIPTION OF THE PREFERRED EMBODIMENTS

Embodiments of the present invention are described below with reference to the drawings.

(First Embodiment)

Figure 1:
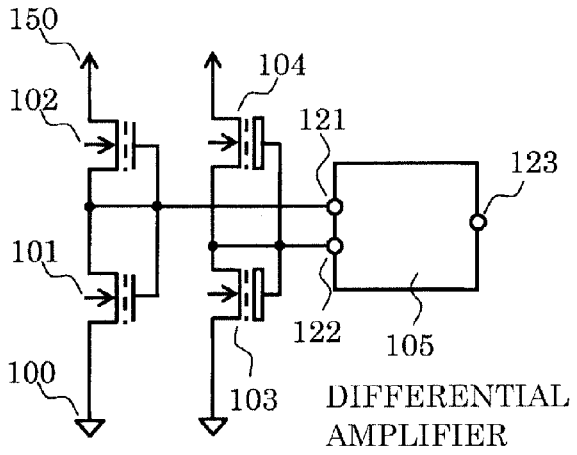
FIG. 1 is a circuit diagram of a reference voltage circuit according to a first embodiment of the present invention.

FIG. 1 is a circuit diagram of a reference voltage circuit according to a first embodiment of the present invention.

The reference voltage circuit according to the first embodiment includes N-channel depletion transistors 101, 102, 103, and 104, a differential amplifier circuit 105, a power supply terminal 150, and a ground terminal 100. The differential amplifier circuit 105 includes input terminals 121 and 122 and an output terminal 123.

Next, connections in the reference voltage circuit according to the first embodiment are described.

The N-channel depletion transistor 101 has a gate and a drain which are connected to the input terminal 121 of the differential amplifier circuit 105, and a source connected to the ground terminal 100. The N-channel depletion transistor 102 has a gate and a source which are connected to the input terminal 121 of the differential amplifier circuit 105, and a drain connected to the power supply terminal 150. The N-channel depletion transistor 103 has a gate and a drain which are connected to the input terminal 122 of the differential amplifier circuit 105, and a source connected to the ground terminal 100. The N-channel depletion transistor 104 has a gate and a source which are connected to the input terminal 122 of the differential amplifier circuit 105, and a drain connected to the power supply terminal 150.

Next, the operation of the reference voltage circuit according to the first embodiment is described.

The N-channel depletion transistors 101 and 102 are set to have the same threshold Vtndm. The N-channel depletion transistors 103 and 104 are set to have the same threshold Vtndl. Those thresholds are set as Vtndm<Vtndl, where Vtndm is lower than Vtndl. The N-channel depletion transistors 102 and 104 operate in the saturation region. The N-channel depletion transistors 101 and 103 operate in the non-saturation region (variable resistance region). The aspect ratios (W/L) of the N-channel depletion transistors 101 and 102 are represented by A101 and A102, respectively. The aspect ratios of the N-channel depletion transistors 103 and 104 are represented by A103 and A104, respectively. A voltage of the node 121 is determined as follows.

[Ex. 3]

$$V_{121} = \left(1 - \frac{\sqrt{A_{101}^2 + A_{102} \cdot A_{101}}}{A_{101}}\right) V_{tndm} \tag{3}$$

A temperature gradient of the input terminal 121 is determined as follows.

[Ex. 4]

$$\frac{dV_{121}}{dt} = \left(1 - \frac{\sqrt{A_{101}^2 + A_{102} \cdot A_{101}}}{A_{101}}\right) \frac{dV_{tndm}}{dt} \tag{4}$$

A voltage of the input terminal 122 is determined as follows.

[Ex. 5]

$$V_{122} = \left(1 - \frac{\sqrt{A_{103}^2 + A_{104} \cdot A_{103}}}{A_{103}}\right) V_{tndl} \tag{5}$$

A temperature gradient of the input terminal 122 is determined as follows.

[Ex. 6]

$$\frac{dV_{122}}{dt} = \left(1 - \frac{\sqrt{A_{103}^2 + A_{104} \cdot A_{103}}}{A_{103}}\right) \frac{dV_{tndl}}{dt} \tag{6}$$

As is apparent from Expressions (3) and (4), a constant voltage circuit is formed by the N-channel depletion transistors 101 and 102, and the voltage value and the temperature gradient of the input terminal 121 are determined by the threshold and the aspect ratios of the N-channel depletion transistors 101 and 102. As is apparent from Expressions (5) and (6), a constant voltage circuit is formed by the N-channel depletion transistors 103 and 104, and the voltage value and the temperature gradient of the input terminal 122 are determined by the threshold and the aspect ratios of the N-channel depletion transistors 103 and 104. In this case, for example, if the respective transistors have the same aspect ratio, the voltage of the input terminal 121 and the voltage of the input terminal 122 are determined as V121<V122 from Vtndm<Vtndl. The influence of the threshold on the temperature gradient differs slightly because the same depletion transistors are used. Through the adjustment of the aspect ratios of the N-channel depletion transistors 102 and 104, both the input terminals 121 and 122 are allowed to have almost the same gradient. The voltages of the input terminals 121 and 122 having the same temperature gradient are input to the differential amplifier circuit 105, and the difference thereof is output from the output terminal 123. Thus, a voltage with improved temperature characteristics can be obtained.

As described above, the depletion transistors having different threshold voltages are used, and hence a reference voltage circuit with improved temperature characteristics can be obtained.

(Second Embodiment)

Figure 2:
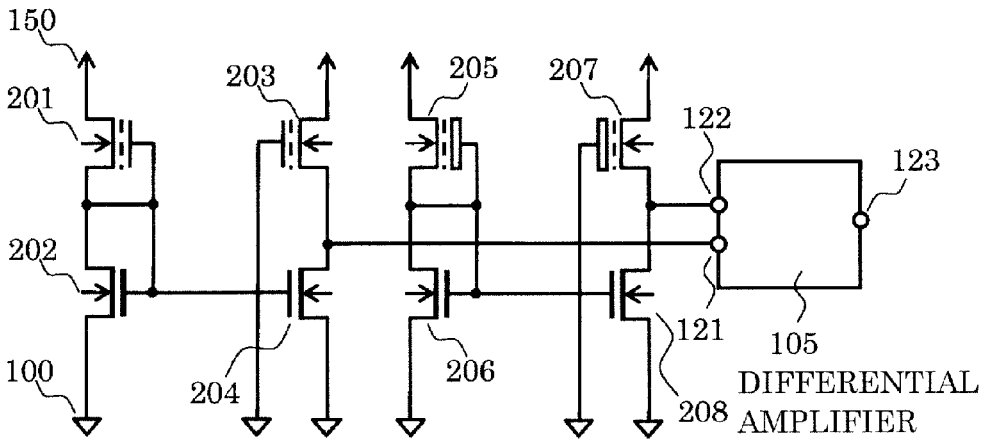
FIG. 2 is a circuit diagram of a reference voltage circuit according to a second embodiment of the present invention.

FIG. 2 is a circuit diagram of a reference voltage circuit according to a second embodiment of the present invention.

The reference voltage circuit according to the second embodiment includes N-channel depletion transistors 201, 203, 205, and 207, NMOS transistors 202, 204, 206, and 208, a differential amplifier circuit 105, a power supply terminal 150, and a ground terminal 100. The differential amplifier circuit 105 includes input terminals 121 and 122 and an output terminal 123.

Next, connections in the reference voltage circuit according to the second embodiment are described.

The N-channel depletion transistor 201 has a gate and a source which are connected to a drain and a gate of the NMOS transistor 202, and has a drain connected to the power supply terminal 150. The NMOS transistor 202 has a source connected to the ground terminal 100. The NMOS transistor 204 has a gate connected to the gate of the NMOS transistor 202, a drain connected to a source of the N-channel depletion transistor 203 and the input terminal 121, and a source connected to the ground terminal 100. The N-channel depletion transistor 203 has a gate connected to the ground terminal 100 and a drain connected to the power supply terminal 150. The N-channel depletion transistor 205 has a gate and a source which are connected to a drain and a gate of the NMOS transistor 206, and has a drain connected to the power supply terminal 150. The NMOS transistor 206 has a source connected to the ground terminal 100. The NMOS transistor 208 has a gate connected to the gate of the NMOS transistor 206, a drain connected to a source of the N-channel depletion transistor 207 and the input terminal 122, and a source connected to the ground terminal 100. The N-channel depletion transistor 207 has a gate connected to the ground terminal 100 and a drain connected to the power supply terminal 150.

Next, the operation of the reference voltage circuit according to the second embodiment is described.

The N-channel depletion transistors 201 and 203 are set to have the same threshold Vtndm. The N-channel depletion transistors 205 and 207 are set to have the same threshold Vtndl. Those thresholds are set as Vtndm<Vtndl, where Vtndm is lower than Vtndl. The aspect ratios of the N-channel depletion transistors 201 and 203 are represented by A201 and A203, respectively. The aspect ratios of the N-channel depletion transistors 205 and 207 are represented by A205 and A207, respectively. The NMOS transistors 202 and 204 form a current mirror, and the same amount of current flows through the N-channel depletion transistors 201 and 203. The NMOS transistors 206 and 208 form a current mirror, and the same amount of current flows through the N-channel depletion transistors 205 and 207. The currents flowing through the N-channel depletion transistors 201, 203, 205, and 207 are represented by I201, I203, 1205, and 1207, respectively. The mobility of electrons is represented by μ0, and the gate capacitance is represented by Cox. The current I201 is determined as follows.

[Ex. 7]

$$I_{201}=\tfrac{1}{2}\mu_0 c_{ox} A_{201}(V_{tndm})^2 \quad (7)$$

The current I203 is determined as follows.

[Ex. 8]

$$I_{203}=\tfrac{1}{2}\mu_0 c_{ox} A_{203}(V_{121}-V_{tndm})^2 \quad (8)$$

V121 is a voltage of the input terminal 121. From I201=I203, Expressions (7) and (8) are solved for V121 to obtain Expression (9).

[Ex. 9]

$$V_{121}=\left(\sqrt{\frac{A_{201}}{A_{203}}+1}\right)V_{tndm}\ \ldots \quad (9)$$

A temperature gradient of the input terminal 121 is determined as follows.

[Ex. 10]

$$\frac{dV_{121}}{dt}=\left(\sqrt{\frac{A_{201}}{A_{203}}+1}\right)\frac{dV_{tndm}}{dt}\ \ldots \quad (10)$$

Similarly, a voltage of the input terminal 122 is determined as follows.

[Ex. 11]

$$V_{122}=\left(\sqrt{\frac{A_{205}}{A_{207}}+1}\right)V_{tndl}\ \ldots \quad (11)$$

A temperature gradient of the input terminal 122 is determined as follows.

[Ex. 12]

$$\frac{dV_{122}}{dt}=\left(\sqrt{\frac{A_{205}}{A_{207}}+1}\right)\frac{dV_{tndl}}{dt}\ \ldots \quad (12)$$

As is apparent from Expressions (9) and (10), a constant voltage circuit is formed by the N-channel depletion transistors 201 and 203 and the NMOS transistors 202 and 204. Further, the voltage value and the temperature gradient of the input terminal 121 are determined by the threshold and the aspect ratios of the N-channel depletion transistors 201 and 203. As is apparent from Expressions (11) and (12), a constant voltage circuit is formed by the N-channel depletion transistors 205 and 207 and the NMOS transistors 206 and 208. Further, the voltage value and the temperature gradient of the input terminal 122 are determined by the threshold and the aspect ratios of the N-channel depletion transistors 205 and 207. In this case, for example, if the respective transistors have the same aspect ratio, the voltage of the input terminal 121 and the voltage of the input terminal 122 are determined as V121<V122 from Vtndm<Vtndl. The influence of the threshold on the temperature gradient differs slightly because the same depletion transistors are used. Through the adjustment of the aspect ratios of the N-channel depletion transistors 201, 203, 205, and 207, both the input terminals 121 and 122 are allowed to have almost the same gradient. The voltages of the input terminals 121 and 122 having the same temperature gradient are input to the differential amplifier circuit 105, and the difference thereof is output from the output terminal 123. Thus, a voltage with improved temperature characteristics can be obtained.

As described above, the depletion transistors having different threshold voltages are used, and hence a reference voltage circuit with improved temperature characteristics can be obtained.

(Third Embodiment)

Figure 3:
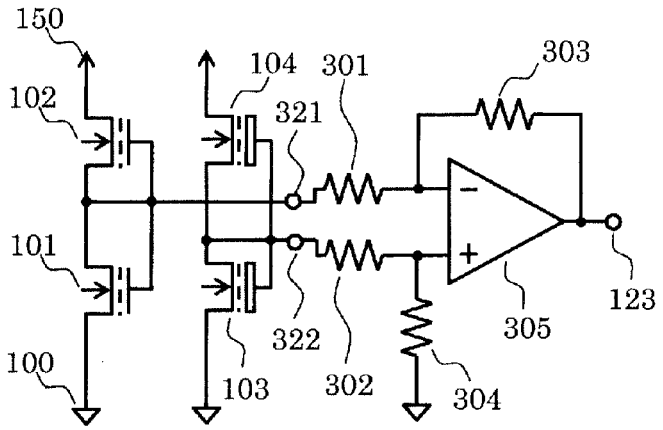
FIG. 3 is a circuit diagram of a reference voltage circuit according to a third embodiment of the present invention.

FIG. 3 is a circuit diagram of a reference voltage circuit according to a third embodiment of the present invention.

The difference from the first embodiment of FIG. 1 resides in that the configuration of the differential amplifier circuit 105 is specifically illustrated.

A node 321 is connected to the gate of the N-channel depletion transistor 102 and one terminal of a resistor 301. A node 322 is connected to the gate of the N-channel depletion transistor 104 and one terminal of a resistor 302. The other terminal of the resistor 301 is connected to an inverting input terminal of an operational amplifier 305 and one terminal of a resistor 303. The other terminal of the resistor 302 is connected to a non-inverting input terminal of the operational amplifier 305 and one terminal of a resistor 304. The other terminal of the resistor 303 is connected to the output terminal 123. The other terminal of the resistor 304 is connected to the ground terminal 100. An output of the operational amplifier 305 is connected to the output terminal 123.

Next, the operation of the reference voltage circuit according to the third embodiment is described.

A voltage V321 of the node 321 and a voltage V322 of the node 322 are set to have the same temperature gradient similarly to the first embodiment. The resistance values of the resistors 301 and 302 are represented by R1, and the resistance values of the resistors 303 and 304 are represented by R2. A voltage V123 of the output terminal 123 is determined as follows.

[Ex. 3]

$$V_{123}=\frac{R_2}{R_1}(V_{321}-V_{322})\ \ldots \quad (13)$$

As is apparent from Expression (13), the difference can be obtained between the voltages having the same temperature gradient. Therefore, through the adjustment of the resistance values, the voltage of the output terminal can also be adjusted.

As described above, the depletion transistors having different threshold voltages are used, and hence a reference voltage circuit with improved temperature characteristics can be obtained. Further, through the adjustment of the resistance values of the differential amplifier circuit, the voltage value of a reference voltage can also be adjusted.

(Fourth Embodiment)

Figure 4:
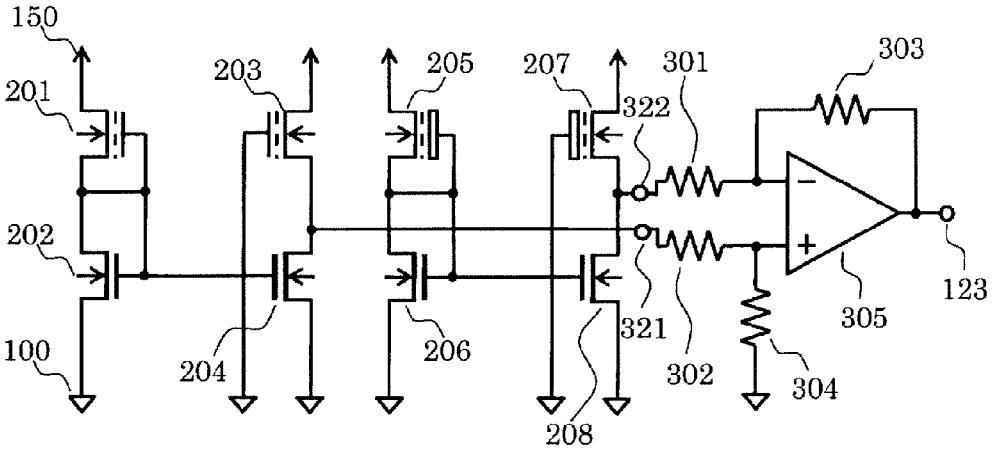
FIG. 4 is a circuit diagram of a reference voltage circuit according to a fourth embodiment of the present invention.
Figure 5:
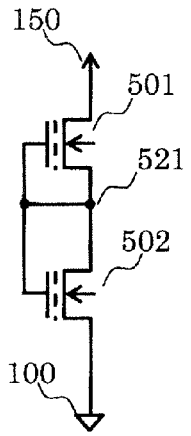
FIG. 5 PRIOR ART
FIG. 5 is a circuit diagram illustrating a conventional reference voltage circuit.

FIG. 4 is a circuit diagram of a reference voltage circuit according to a fourth embodiment of the present invention.

The difference from the second embodiment of FIG. 2 resides in that the configuration of the differential amplifier circuit 105 illustrated in FIG. 2 is specifically illustrated in FIG. 4. The differential amplifier circuit has the same configuration as that in the third embodiment of FIG. 3, and includes components 321, 322, 301, 302, 303, 304, and 305. An output of the operational amplifier 305 is connected to the output terminal 123. With this configuration, too, a reference voltage circuit with improved temperature characteristics can be obtained, and through the adjustment of the resistance values of the differential amplifier circuit, the voltage value of a reference voltage can also be adjusted.

(Fifth Embodiment)

Figure 6:
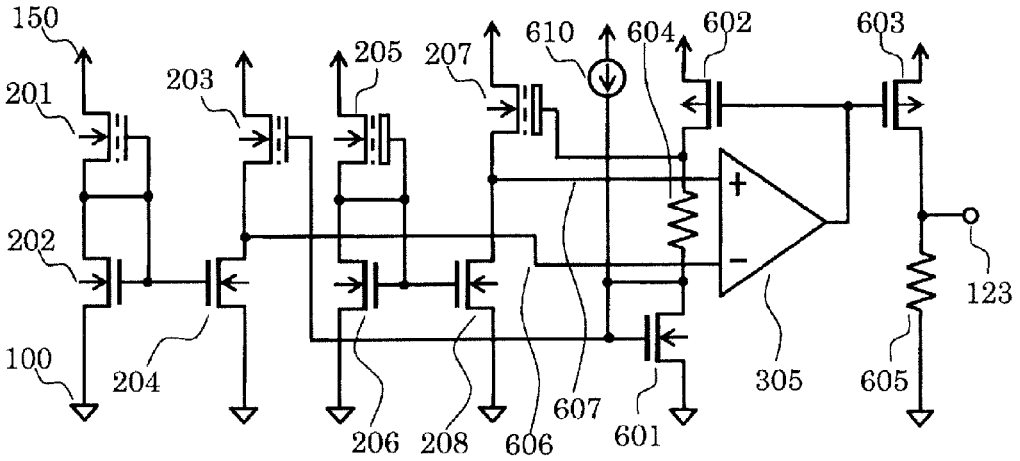
FIG. 6 is a circuit diagram of a reference voltage circuit according to a fifth embodiment of the present invention.

FIG. 6 is a circuit diagram of a reference voltage circuit according to a fifth embodiment of the present invention.

The reference voltage circuit according to the fifth embodiment includes N-channel depletion transistors 201, 203, 205, and 207, NMOS transistors 202, 204, 206, 208, and 601, PMOS transistors 602 and 603, resistors 604 and 605, a constant current circuit 610, an operational amplifier 305, a power supply terminal 150, a ground terminal 100, and an output terminal 123.

Next, connections in the reference voltage circuit according to the fifth embodiment are described.

The N-channel depletion transistor 201 has a gate and a source which are connected to a drain and a gate of the NMOS transistor 202, and has a drain connected to the power supply terminal 150. The NMOS transistor 202 has a source connected to the ground terminal 100. The NMOS transistor 204 has a gate connected to the gate of the NMOS transistor 202, a drain connected to a source of the N-channel depletion transistor 203 and an inverting input terminal of the operational amplifier 305, and a source connected to the ground terminal 100. The N-channel depletion transistor 203 has a gate connected to a gate and a drain of the NMOS transistor 601, and has a drain connected to the power supply terminal 150. The N-channel depletion transistor 205 has a gate and a source which are connected to a drain and a gate of the NMOS transistor 206, and has a drain connected to the power supply terminal 150. The NMOS transistor 206 has a source connected to the ground terminal 100. The NMOS transistor 208 has a gate connected to the gate of the NMOS transistor 206, a drain connected to a source of the N-channel depletion transistor 207 and a non-inverting input terminal of the operational amplifier 305, and a source connected to the ground terminal 100. The N-channel depletion transistor 207 has a gate connected to a drain of the PMOS transistor 602 and a drain connected to the power supply terminal 150. The resistor 604 has one terminal connected to the drain of the NMOS transistor 601 and the other terminal connected to the drain of the PMOS transistor 602. The constant current circuit 610 has one terminal connected to the gate of the NMOS transistor 601 and the other terminal connected to the power supply terminal 150. The PMOS transistor 602 has a gate connected to a gate of the PMOS transistor 603 and an output terminal of the operational amplifier 305, and has a source connected to the power supply terminal 150. The PMOS transistor 603 has a drain connected to one terminal of the resistor 605 and the output terminal 123, and has a source connected to the power supply terminal 150. The other terminal of the resistor 605 is connected to the ground terminal 100.

The NMOS transistor 601, the PMOS transistor 602, the resistor 604, and the constant current circuit 610 together form a feedback circuit. The PMOS transistor 603 and the resistor 605 form an output circuit of the reference voltage circuit.

Next, the operation of the reference voltage circuit according to the fifth embodiment is described.

The N-channel depletion transistors 201 and 203 are set to have the same threshold Vtndm. The N-channel depletion transistors 205 and 207 are set to have the same threshold Vtndl. Those thresholds are set as Vtndm<Vtndl, where Vtndm is lower than Vtndl. The aspect ratios of the N-channel depletion transistors 201 and 203 are represented by A201 and A203, respectively. The aspect ratios of the N-channel depletion transistors 205 and 207 are represented by A205 and A207, respectively. The NMOS transistors 202 and 204 form a current mirror, and the same amount of current flows through the N-channel depletion transistors 201 and 203. In this way, the N-channel depletion transistors 201 and 203 and the NMOS transistors 202 and 204 together form a constant voltage circuit for outputting a source-gate voltage of the N-channel depletion transistor 203. The NMOS transistors 206 and 208 form a current mirror, and the same amount of current flows through the N-channel depletion transistors 205 and 207. In this way, also the N-channel depletion transistors 205 and 207 and the NMOS transistors 206 and 208 together form a constant voltage circuit for outputting a source-gate voltage of the N-channel depletion transistor 207.

An output 606 of a source follower circuit formed by the N-channel depletion transistor 203 and an output 607 of a source follower circuit formed by the N-channel depletion transistor 207 are controlled by the operational amplifier 305 to have the same voltage value. Accordingly, the voltage difference between the source-gate voltage of the N-channel depletion transistor 203 and the source-gate voltage of the N-channel depletion transistor 207 is generated across the resistor 604.

The PMOS transistor 603 operates with the output voltage of the operational amplifier 305 similarly to the PMOS transistor 602, and causes the same current as the current flowing through the resistor 604 to flow through the resistor 605. In this way, a voltage is generated at the output terminal 123. The voltage of the output terminal 123 can be adjusted by the ratio between the resistance values of the resistors 605 and 604. When the resistance value of the resistor 605 is represented by 6R and the resistance value of the resistor 604 is represented by R, a voltage which is six times the voltage generated across the resistor 604 can be generated at the output terminal 123. The NMOS transistor 601 and the constant current circuit 610 are provided in order to increase the input voltages of the operational amplifier 305 by the threshold voltage of the NMOS transistor 601.

As described above, the depletion transistors having different threshold voltages are used, and hence a reference voltage circuit with improved temperature characteristics can be obtained. Further, through the adjustment of the resistance ratio, the voltage value of a reference voltage can also be adjusted.

Note that, the feature of the reference voltage circuit of the present invention is as follows. That is, a current based on a current flowing through an N-channel depletion transistor (such as 102) whose gate and source are connected to each other is caused to flow through an N-channel depletion transistor (such as 101) having the same threshold, to thereby generate a voltage between a gate and a source thereof, and a current based on a current flowing through an N-channel depletion transistor (such as 104) whose gate and source are connected to each other is caused to flow through an N-channel depletion transistor (such as 103) having the same threshold, to thereby generate a voltage between a gate and a source thereof. A reference voltage is generated based on a difference voltage between the two voltages, to thereby obtain a reference voltage having less voltage fluctuations with respect to a temperature change. It should be therefore understood that any circuit configuration capable of realizing the above-mentioned configuration can be employed. For example, even if N-channel depletion transistors are replaced with P-channel depletion transistors, a reference voltage circuit having the same effects can be realized through the corresponding changes of the other transistors.

What is claimed is:

1. A reference voltage circuit, comprising:

a first constant voltage circuit and a second constant voltage circuit, wherein the first constant voltage circuit includes:

a first depletion transistor including a gate and a source which are connected to each other, and a drain connected to a first power supply terminal;

a first MOS transistor including a gate and a drain which are connected to the gate and the source of the first depletion transistor, and a source connected to a second power supply terminal;

a second MOS transistor including a gate connected to the gate of the first MOS transistor, a source connected to the second power supply terminal, and a drain connected to an output terminal of the first constant voltage circuit; and a third depletion transistor including a gate connected to the second power supply terminal, a drain connected to the first power supply terminal, and a source connected to the drain of the second MOS transistor, wherein the second constant voltage circuit includes:

a second depletion transistor having a threshold different from a threshold of the first depletion transistor, including a gate and a source which are connected to each other, and a drain connected to the first power supply terminal;

a third MOS transistor including a gate and a drain which are connected to the gate and the source of the second depletion transistor, and a source connected to the second power supply terminal;

a fourth MOS transistor including a gate connected to the gate of the third MOS transistor, a source connected to the second power supply terminal, and a drain connected to an output terminal of the second constant voltage circuit; and a fourth depletion transistor including a gate connected to the second power supply terminal, a drain connected to the first power supply terminal, and a source connected to the drain of the fourth MOS transistor, and wherein the reference voltage circuit generates a reference voltage based on a potential difference between an output voltage of the first constant voltage circuit and an output voltage of the second constant voltage circuit.

2. The reference voltage circuit according to claim 1, further comprising differential amplifier means, wherein the differential amplifier means receives the output voltage of the first constant voltage circuit and the output voltage of the second constant voltage circuit as inputs, and generates the reference voltage based on the potential difference between the output voltage of the first constant voltage circuit and the output voltage of the second constant voltage circuit.

* * * * *